United States Patent [19]

Wang

[11] Patent Number: 4,601,440

[45] Date of Patent: Jul. 22, 1986

[54] LINE EXTENDER AND REWINDER FOR KITE

[76] Inventor: Kun-Meng Wang, No. 57, Lane 50, Chung Cheng Rd., Pei Hsin Ts'un, Tai Pao Hsiang, Chia-I, Taiwan

[21] Appl. No.: 756,200

[22] Filed: Jul. 18, 1985

[51] Int. Cl.[4] ..... B65H 75/40; B64C 31/06

[52] U.S. Cl. ..... 242/96; 242/68.3; 244/155 R

[58] Field of Search ..... 244/155 A, 155 R; 242/96, 68.3; 114/254

[56] References Cited

U.S. PATENT DOCUMENTS

| | | | |
|---|---|---|---|
| 1,319,429 | 10/1919 | Spiro | 242/68.3 |
| 1,957,884 | 5/1934 | Green | 242/68.3 |
| 2,434,479 | 1/1948 | Allen | 242/96 |
| 2,587,432 | 2/1952 | Bellah | 244/155 A |
| 4,129,273 | 12/1978 | Hill | 244/155 A |
| 4,172,567 | 10/1979 | Post | 242/96 |

*Primary Examiner*—Galen Barefoot
*Attorney, Agent, or Firm*—Armstrong, Nikaido, Marmelstein & Kubovcik

[57] ABSTRACT

A line extender and rewinder for a kite comprising a main body, a connector, a spring leaf, a jacket, a column and a wedge body. The main body has a passing hole, a flange, holes, and segment line winding seats and recessions. The flange is at a side of the passing hole, and has a toothed slot. The segment has a slot and curved groove on it. The connector has a hollow post at one end, a moving rod at another end, and a ring in the middle. The hollow post has a recession at one end and a threaded inner surface at the other end. The moving rod has two blocks at one end to facilitate passing through the passing hole at the main body, and a recession at another end. The spring leaf is made of bent steel wire with two protuberances on it. The column has an end with a ball. The spring leaf is loaded within the connector, which is then connected to the jacket and caused to pass through the passing hole of the main body so that the blocks at the moving rod are at another side of the main body. The wedge block is inserted into the V-slot formed by the blocks. A protuberance of the spring leaf passes through the recession of the main body and is held within the toothed slot at the flange of the main body while another protuberance is held within a recession at the connector.

1 Claim, 6 Drawing Figures

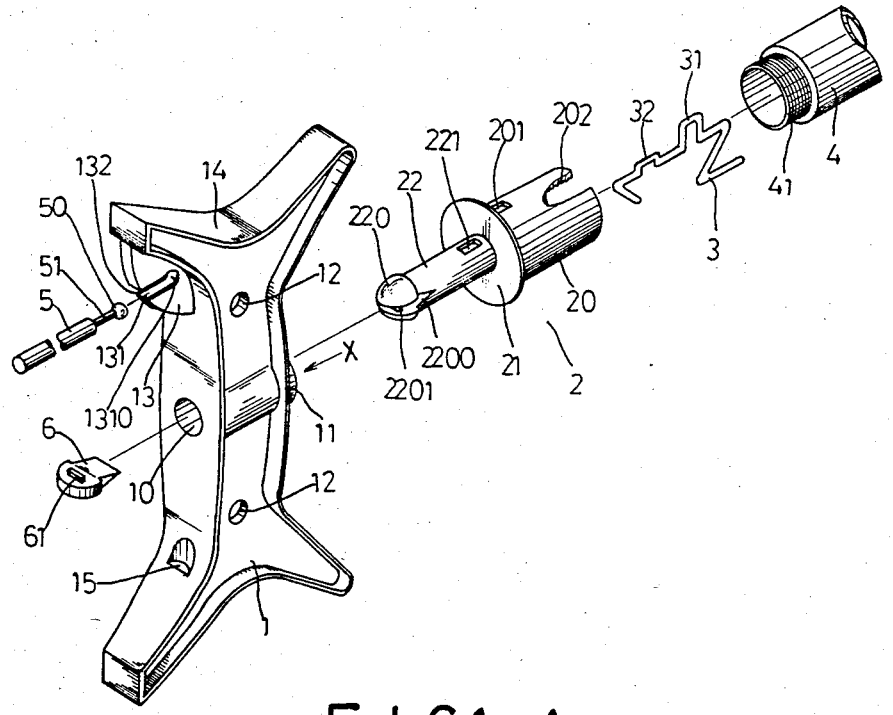
FIG.1-A
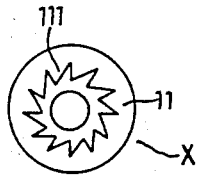
FIG.1-B

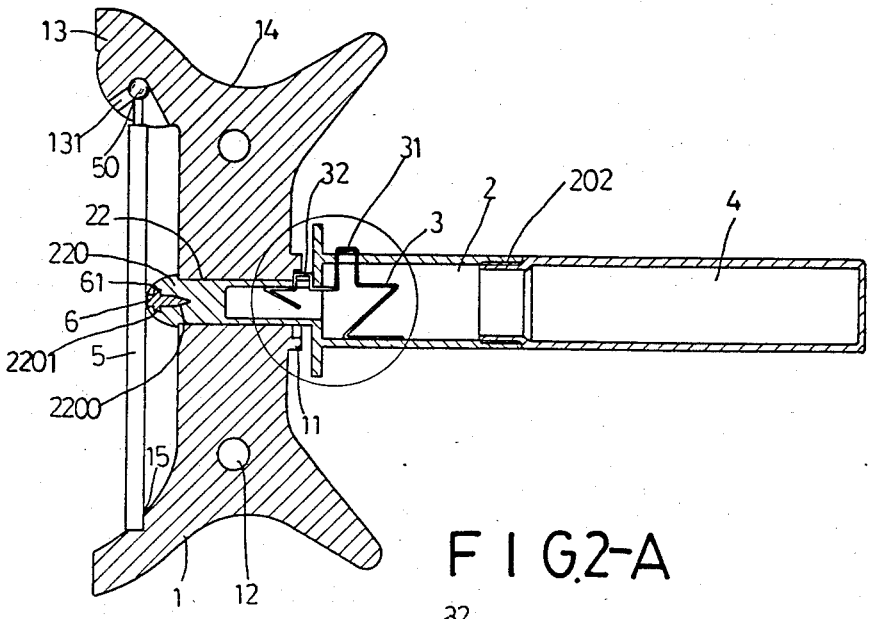
FIG.2-A
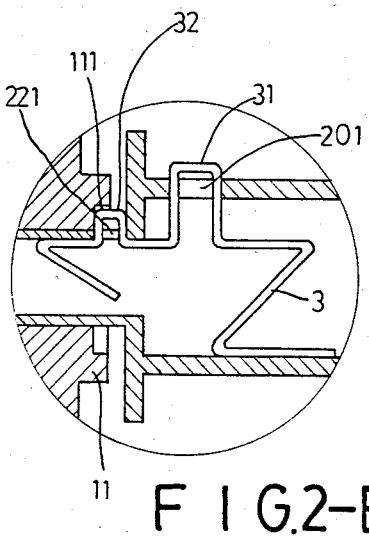
FIG.2-B

LINE EXTENDER AND REWINDER FOR KITE

BACKGROUND OF THE INVENTION

FIG. 4 shows a conventional line extender and rewinder for a kite which has line wound around its line winding bar (b) and fixed to the bar (b) at opening (c1) of a segment (c) on its left side. For line extension, disengage the line from the opening (c1), shake its handle (a) up and down to extend the line rapidly so that the kite connecting to the line can fly far away. However, with this device, no matter how it is shaked, it is impossible to control extension speed and rewinding at discretion, and it is impossible to rewind the line rapidly due to inherent defect of its design.

It is, therefore, an object of the present invention to obviate and mitigate the above-noted drawback.

SUMMARY OF THE INVENTION

It is the primary object of the present invention to provide a line extender which can extend line rapidly simply by pressing a protuberance of a spring leaf to disengage another protuberance from a toothed slot at a main body which is properly connected to the spring leaf and a connector.

It is another object of the present invention to provide a line rewinder by turning a column in a curved groove on a segment at a side of the main body.

Detailed description of the present invention is given below with reference to the attached drawings.

BRIEF DESCRIPTION OF THE DRAWINGS

FIGS. 1A and 1B are fragmental views of the present invention;

FIGS. 2A and 2B are cross-sectional views of the present invention;

DETAILED DESCRIPTION OF THE PREFERRED EMBODIMENT

Figure 3:
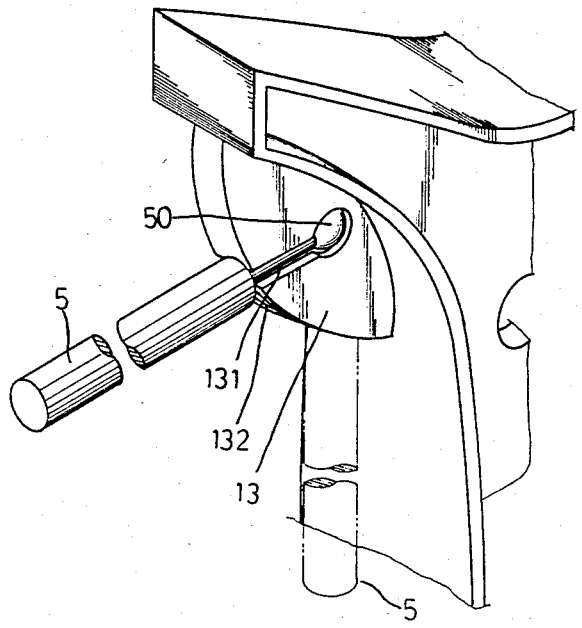
FIG. 3 illustrates a preferred embodiment of the column and segment at the main body for the present invention.
Figure 4:
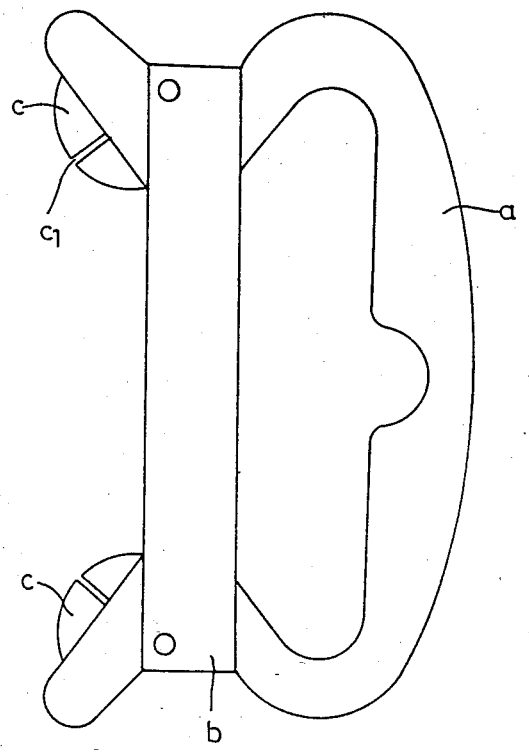
FIG.4 PRIOR ART
FIG. 4 shows a conventional line extender and rewinder for kite.

As illustrated in FIGS. 1A and 1B, the present invention comprises a main body (1), a connector (2), a spring leaf (3), a jacket (4), a column (5), and a wedge block (6). The main body (1) is made of plastics in a form similar to "X", and has a passing hole (10) in the middle. There is a flange (11) at the junction between the right side of the main body (1) and the passing hole (10). Along the inner side (as seen along the direction X in FIG. 1A) of the flange, there is a toothed slot (111). Round holes (12) are made at upper and lower ends of the main body (1) on respective appropriate position for line tying. There is a segment (13) at the top of the left side of the main body (1). The segment (13) has a slot (131) in its middle. The slot (131) has a hole (1310) at its right end. The lower end of the slot (131) has a curved groove (132) near the edge of the segment (13). At the left bottom of the main body (1) there is a recession (15). There are line winding seats (14) at both upper and lower ends of the main body (1). The connector (2) is a syringe-like connecting part with a hollow post (20) at one end, a moving rod (22) at another end, and ring (21) in the middle. The hollow post (20) has a recession (201) at a position near the ring (21), and an inner threaded surface (202) at its right end. Each of the upper and lower sides of the left end of the moving rod (22) has a semi-conical block (220), with a small slot (2201) formed in its inner edge. There is a V-slot (2200) between the blocks (220) and said slot (2200) can be contracted while the blocks (220) are pressed so that the moving rod (22) can be inserted into the passing hole (10) easily. The two blocks (220), after being inserted into the passing hole (10), are against the left side wall of the passing hole (10) to hold the moving rod (22) in place. The moving rod (22) has a recession (221) at its right end near the ring (21). The spring leaf (3) is a bent strip made of steel wire with two protuberances (31) and (32). The smaller protuberance (32) at the left side can be kept within the recession (221) on the connector (2), and the larger protuberance (31) can be kept within the recession (201) at the hollow post (20). The jacket (4) is a pipe with threads (41) at one end corresponding to the threads (202) at right end of the connector (2). The column (5) has one end fixed to the recession (15) at bottom of the main body (1), and a ball (50) at another end which is connected to the column by a straight rod (51). The ball (50) can be inserted into the round hole (1310) at the segment (13) of the main body (1) so that the column (5) is moveable along the curved groove (132). The wedge block (6) has a tenon (61) on the upper side and another tenon (61) on the lower side. The wedge block (6) is for inserting into the V-slot (2200) between the blocks (220) at the moving rod (22). The tenons (61) are just corresponding to the small slots (2201) respectively so that the blocks (22) will not disengage from the passing hole (10) easily after the moving rod (22) passes through the passing hole (10).

As shown in FIGS. 2A and 2B. The spring leaf (3) is loaded within the hollow post (20) of the connector (2) and then the jacket (4) is connected to the connector (2) at the threaded surface (202). The blocks (220) of the connector (2) are caused to pass through the main body (1) so that the blocks (220) are located at left side of the main body (1). The wedge block (6) is inserted into v-slot (2200) formed between the blocks (220) so that the tenons (61) are fixed within the slots (2201) respectively. The spring leaf (3) is caused to have its protuberance (32) passing the recession (221) of the connector (2) and then held within the toothed slot (111) at the right flange (11) of the main body (1) so that the connector (2) is firmly fixed to the main body (1). Another protuberance (31) of the spring leaf (3) is held within the recession (201) of the connector (2) for use as a push button.

Referring to FIGS. 1-3, in operation, one end of a line is connected to a kite while another end is tied to the hole (12) at the main body (1). Then, the line is wound about the upper and lower line winding seats (14) for flying and returning the kite. Since the connector (2) is held firmly in the main body (1), the line can not leave the line winding seats (14) thereof. For flying the kite further, just lightly press the protuberance (31) exposed at the recession (201) on the hollow post (20) so that the other protuberance (32) is disengaged from the toothed slot (111), and then, because of the pulling force from the kite, the main body (1) rotates rapidly around the moving rod (22) of the connector (2), and the line is extended rapidly.

To stop line extension, just release the protuberance (31). For returning the kite, disengage an end of the column (5) from the recession (15) and turn the column (5) upwards till horizontal level with the ball (50) as a pivot (as shown in FIG. 3), and then press the protuberance (31) by one hand and hold the column (5) by another hand, thus the main body (1) can be rotated around the moving rod (22) to rewind the line.

In conclusion, the present invention is for extending and rewinding line for kites. It eliminates the defect of a conventional line extender and rewinder which involves complicated procedure in line extension and rewinding. The present invention uses the main body (1), connector (2), spring leaf (3), jacket (4), column (5) and wedge block (6) for efficient and rapid control on line extension and rewinding. It is simple in structure and easy in operation for fun.

I claim:

1. A line extender and rewinder for a kite comprising an X-like plastic main body having a passing hole in the middle, a flange being disposed around an end of the passing hole, a toothed slot formed in the flange, two holes respectively formed at the upper and lower sides of the main body for line tying, a segment disposed at the opposite side of the flange, a long groove formed at the middle of the segment, a hole formed at an end of the groove and a curved groove located at another side of the segment, two line winding seats of which one is formed at the upper side of the main body and the other at the lower side thereof and a recession formed at the bottom of the main body:

a connector in the form of a syringe, having a hollow post at one end, a moving rod at another end, and a ring in the middle, a recession disposed at the hollow post near the ring, an inner threaded surface formed at another end of the hollow post, two semiconical blocks formed at one end of the moving rod, a recession formed at the inner edge of each block and a v-slot formed between the blocks to be capable of inserting the moving rod into the passing hole of the main body, and a recession formed at the moving rod near the ring;

a spring leaf, made of bent steel wire, having two protuberances, of which the smaller protuberance can pass through the recession of the moving rod and held within the toothed slot of the main body, and the larger protuberance can be held within the recession of the hollow post;

a jacket with threads at one end for connecting to the threaded surface of the hollow post of the connector;

a column with one end being held within the recession at bottom of the main body, said column provided at another end with a ball which can be inserted into the hole at the main body so that the column is moveable along the curved groove; and a wedge block with a tenon at the upper side and another tenon at the lower side for respectively inserting into the recessions of the semiconical blocks while the wedge block is inserted into v-slot between the blocks at the moving rod so that the moving rod will not disengage from the passing hole of the main body after passing through the passing hole thereof.

* * * * *